US005411328A

United States Patent [19]

You

[11] Patent Number: 5,411,328

[45] Date of Patent: May 2, 1995

[54] REFRIGERATOR HAVING A COOL AIR LEAK-PREVENTION DEVICE

[75] Inventor: Hyun S. You, Seoul, Rep. of Korea

[73] Assignee: Samsung Electronics Co., Ltd., Kyungki, Rep. of Korea

[21] Appl. No.: 147,574

[22] Filed: Nov. 5, 1993

[30] Foreign Application Priority Data

Nov. 9, 1992 [KR] Rep. of Korea ..... 92-21935 U

[51] Int. Cl.[6] ..... E06B 7/16

[52] U.S. Cl. ..... 312/405; 312/296; 49/368; 62/441

[58] Field of Search ..... 312/405, 400–401, 312/215, 220, 138.1, 139, 140, 405.1, 296, 116; 49/367–368, 473, 475, 480.1; 62/440–441, 265

[56] References Cited

U.S. PATENT DOCUMENTS

| | | | |
|---|---|---|---|
| 1,918,865 | 7/1933 | Purdy | 49/313 |
| 2,692,809 | 10/1954 | Kesling | 312/405 |
| 3,590,531 | 7/1971 | Childs | 49/368 |
| 4,288,135 | 9/1981 | Buchser et al. | 312/296 |
| 4,428,153 | 1/1984 | Klinger et al. | 49/368 X |
| 4,711,098 | 12/1987 | Kuwabara et al. | 62/441 |

FOREIGN PATENT DOCUMENTS

| | | |
|---|---|---|
| 4-136679 | 5/1992 | Japan . |
| 4-187981 | 7/1992 | Japan . |

OTHER PUBLICATIONS

Translated Japanese Abstract: Nonaka, Hikari; "Door Device for Refrigerator or the Like", May 11, 1992, Toshiba Corp., Pat. No. 4,136,679(A).

Translated Japanese Abstract: Yamanaka, Tomiji; "Door Device For Refrigerator", Jul. 1, 1992, Hitachi Ltd.,; Pat. No. 4,187,981(A).

*Primary Examiner*—James R. Brittain
*Assistant Examiner*—Robert J. Sandy
*Attorney, Agent, or Firm*—Burns, Doane, Swecker & Mathis

[57] ABSTRACT

A refrigerator has a body forming a compartment, and first and second doors mounted in side-by-side relationship on the body for closing the compartment. Each door is hinged along an outer vertical edge thereof such that the inner vertical edges of the doors face one another and form a gap when the doors are closed. In order to prevent cool air loss through that gap, a leak prevention member is hinged on the back side of the first door for rotation about a vertical axis. When the first door is closed, a pin on the leak prevention member engages a guide groove formed on the body for rotating the leak prevention member to an operative position in which it extends across the gap to resist cool air leakage. A locking element carried by the leak prevention member locks the leak prevention element against rotation to its operative position while the first door is open. The locking element engages an upwardly inclined portion of the groove during closing of the first door to raise the locking element to an unlocking position permitting rotation of the leak prevention member to its operative position.

14 Claims, 6 Drawing Sheets

FIG. 5(A)
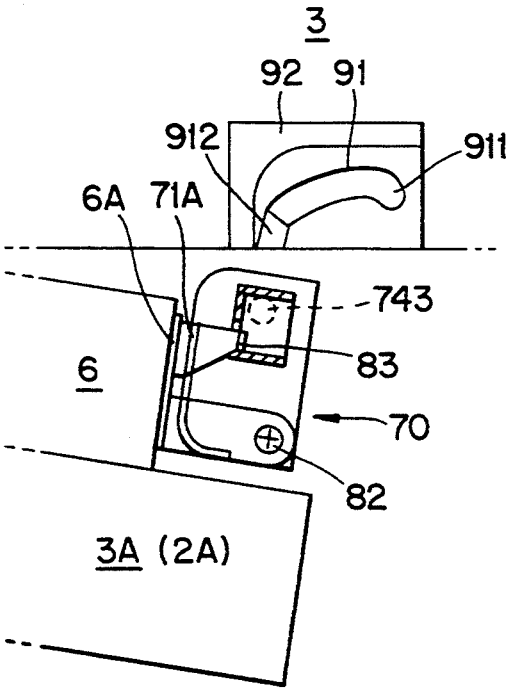
FIG. 5(B)
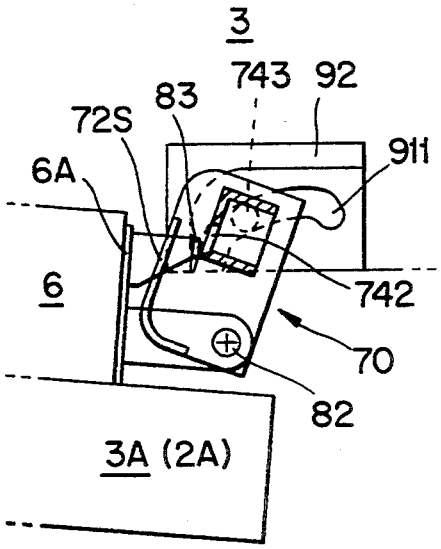
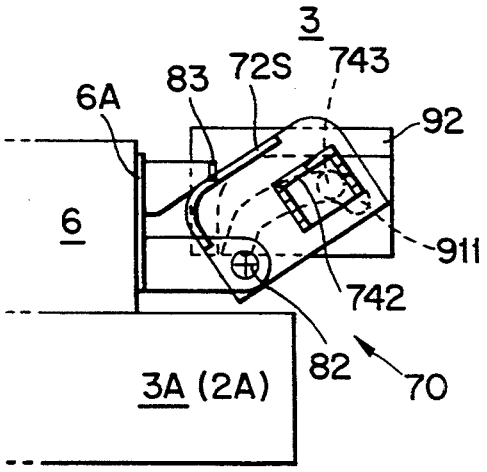
FIG. 5(C)
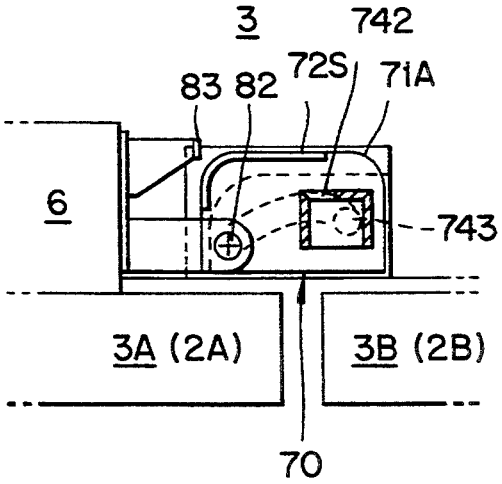
FIG. 5(D)

FIG. 6(A)
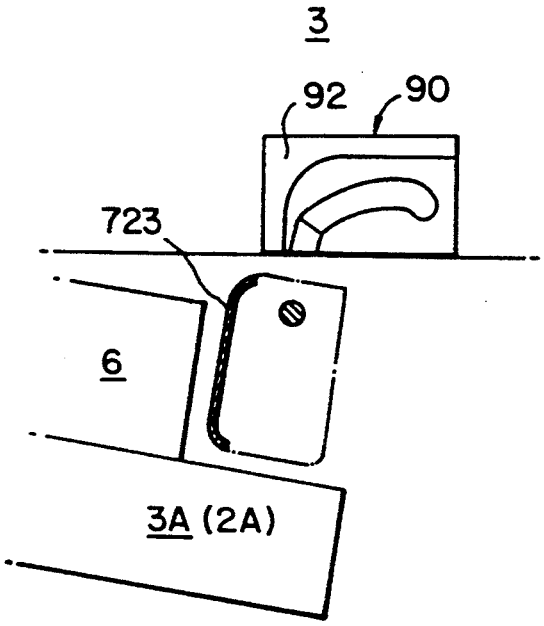
FIG. 6(B)
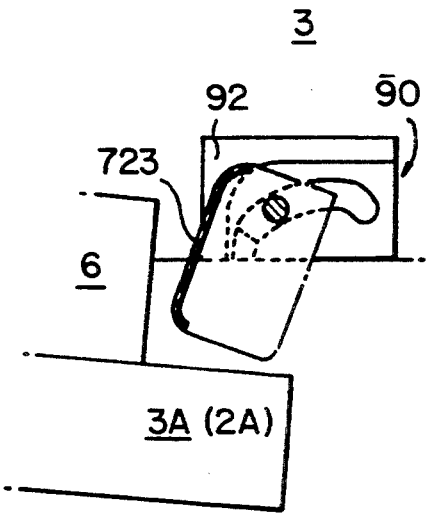
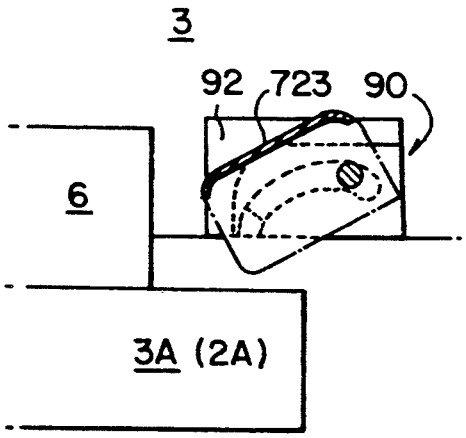
FIG. 6(C)
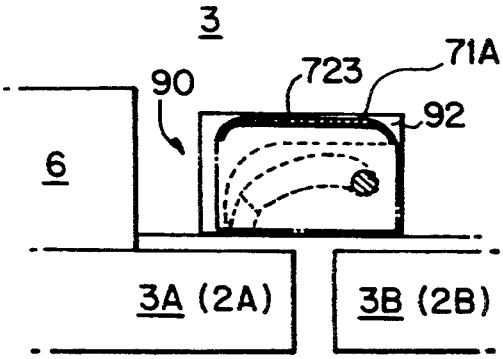
FIG. 6(D)

REFRIGERATOR HAVING A COOL AIR LEAK-PREVENTION DEVICE

FIELD OF THE INVENTION

The present invention is related to a refrigerator having a cool air leak prevention device that is provided on the vertical side wall of one of the doors attached to the front opening of a refrigerator compartment.

BACKGROUND OF THE INVENTION

A refrigerator is provided with doors which are installed on the front surface of both the freezing compartment and the refrigerating compartment and are hinged on the vertical side surfaces of the refrigerator. Between the non-hinged side wall of each door a gap is created through which cool air escapes from the compartment. To prevent the leakage of the cool air a leak prevention device is attached to the non-hinged side surface of the shelf which is mounted on the inward-facing surface of the door.

A typical structure is disclosed in Japanese Patent Laid Open No. 1992-136679 and 1992-187981 as illustrated in FIGS. 7,8 and 9.

Numerals 123,124 represent doors which are attached to the vertical side surfaces of the refrigerator in order to close the opening of the compartment 122. The door 124 has a cool air leak prevention device 128 mounted on a non-hinged side wall of shelf 135. A spring 129 is interconnected between the shelf 135 and the leak prevention device 128. A hinge 127 is located on the non-hinged side wall of the shelf 135 so that the leak prevention device 128 moves between the position shown in FIG. 7 and that shown in FIG. 8 (or FIG. 9). When the door 124 is opened the leak prevention device 128 is in the folded position as shown in FIG. 7 due to the resilient force of the spring 129.

As the door 124 is closed, a groove 128A formed in the upper and lower ends of the leak prevention device 128 receives a guide pin 130 which is located on the upper and lower wall of the compartment 122 to cause the devices 128 to pivot clockwise. When the door 124 is completely closed as shown in FIG. 8, the leak prevention device 128 covers the gap formed between the door 124 and the door 123.

However, when door 124 is in the opened position any excess force on the door is directed to the folded leak prevention device 128 which turns the leak prevention device 128 into the covering or unfolded position as shown in FIG. 8 even though the door is still open. That is, the leak prevention device 128 slides past the neutral point of the spring 129 and the leak prevention device 128 is positioned as shown in FIG. 8 but with the door still open. This operation can be seen in the FIG. 9. If the open door 124 with the unfolded leak prevention device 128 is closed, the guide pin 130 can be damaged by the movement of the leak prevention device 128. If the door 124 with the unfolded leak prevention device 128 is closed, after the other door 183, i.e., the door without the leak prevention device 128 has been closed the leak prevention device 128 can be damaged by the door 123.

The U.S. Pat. No. 4,711,098 discloses a structure having the housing part and magnetic securing means which may temporarily solve the above problem.

Further, a gap is created between each end surface of the leak prevention device 128 and the surface having the guide pin 130. Through this gap the cool air escapes from the compartment.

SUMMARY OF THE INVENTION

The object of the present invention provides a refrigerator cool air leak prevention device which prevents damage to the device regardless of which door is closed first.

Another object of the present invention is to provide a refrigerator cool air leak prevention device which does not rotate when the door is in the open position.

Another object of the present invention is to provide a refrigerator cool air leak prevention device which prevents the cool air in the compartment to not leak through the gap between the non-hinged adjoining portion of the doors as well as the gap between each end surface of the air leak prevention device and the respective top or bottom surface of the compartment.

According to the present invention, there is provided a refrigerator comprising:

first and second doors which are hinged on the vertical axis on the front surfaces of each compartment;

cool air leak prevention devices mounted with hinges on the inward-facing surface of the first door and one surface which faces the hinged portion of the first door and the leak prevention device moving from the first position defined as folded into the hinged portion by the first door to a second position defined as blocking the gap between the unhinged edge of the doors;

guiding means mounted on the upper and lower surface of each compartment for guiding the movement of the cool air leak prevention device;

locking means for restricting the movement of the leak prevention device when the leak prevention device being in the second position.

Preferably, the first door comprises additionally mounting means for securing the rotation of the cool air leak prevention device and a protruding portion of the mounting member.

Preferably, the cool air leak prevention device comprises a first spring which provides the cool air leak preventing device with a resilient force so as to force one of the vertical surfaces of the cool air leak prevention device to face the non-hinged side wall of the shelf, and a locking portion which moves in a vertical direction in respect to a rotation plane of said cool air leak prevention device.

Preferably, the locking portion is held in the locked position by a resilient force of a second spring.

Preferably, the cool air leak prevention device is rotated along the configuration of the guiding member and simultaneously the locking portion is held in the unlocked position.

Preferably, the locking portion moves in a direction to compress the second spring along a configuration of the guiding member and the protruding portion of the mounting member is released from the locking portion in order to be placed in an unlocked position.

Preferably, the protruding portion of the mounting member is secured by the locking portion when it is in the locked position.

When the door is in the opened position, the first spring pushes one side surface of the cool air leak prevent member to face the non-hinged side wall of the shelf. Simultaneously, the locking portion is moved in the direction vertical from the rotation plane of the cool air leak prevention device. The locking portion is interlocked by the protruding portion of the mounting member. Thus, the cool air leak prevention device can not be rotated.

When the door is in the process of being closed, the shaft of the locking portion enters the guiding member and travels along the groove of the guiding member. Simultaneously, the shaft moves upward with respect to the configuration of the groove where it comes into contact with the resilient force of the second spring. The locking portion, which is restricted by the protruding portion, is in the release position. Thus, the cool air leak prevention device can be rotated. Accordingly, the cool air interrupting portion of the leak prevention device covers the facing surface of the compartment guiding member as the leak prevention device moves along the guiding track.

BRIEF DESCRIPTION OF THE DRAWINGS

FIGS. 5A–5D are fragmentary plan views of a cool air leak prevention device illustrating the steps of an operating process thereof according to the present invention;

FIGS. 6A–6D are fragmentary plan views of a cool air leak prevention device illustrating the steps of an operating process of the leak preventing portion in according to the present invention;

DETAILED DESCRIPTION OF THE PREFERRED EMBODIMENT

Figure 1:
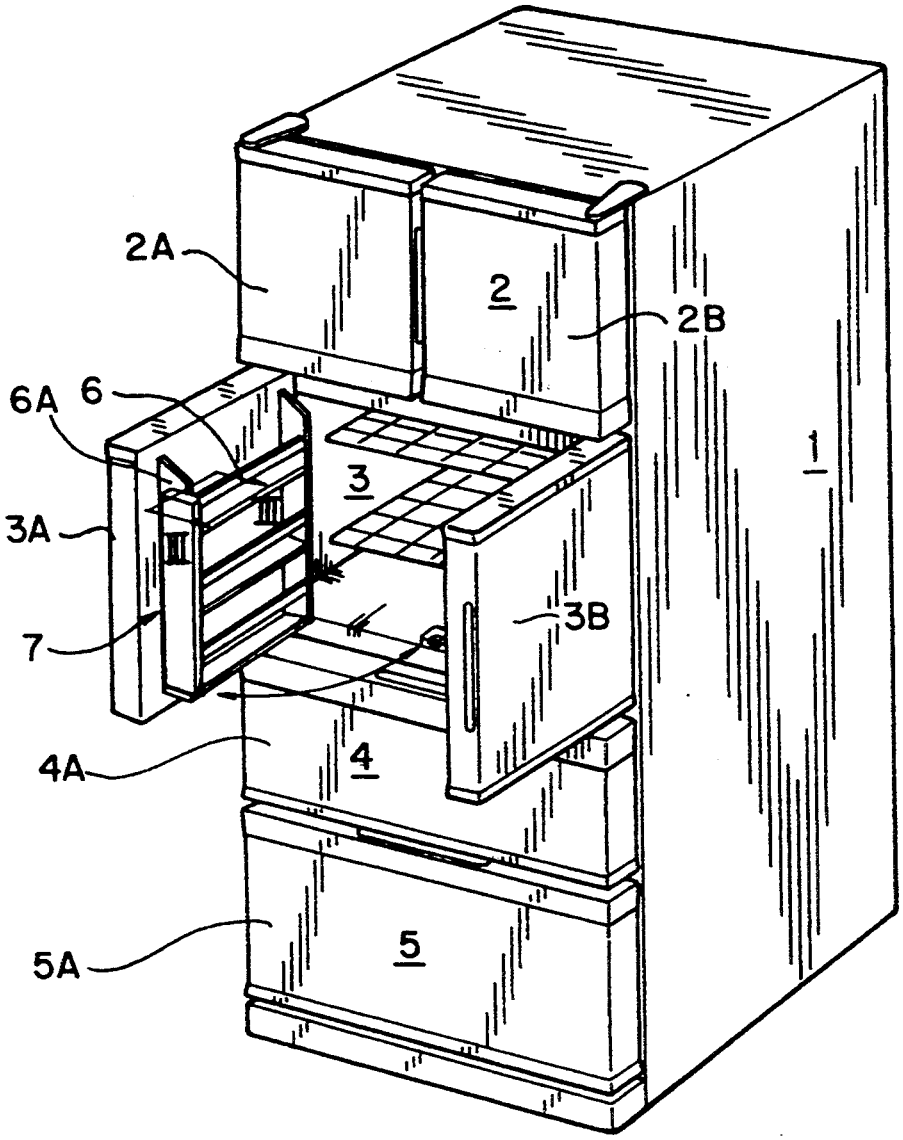
FIG. 1 is a perspective view of a refrigerator illustrating an opened door on which a cool air leak prevention device is mounted in accordance with the present invention.

FIG. 1 illustrates a perspective view of a refrigerator having a cool air leak prevention device in accordance with the present invention.

The refrigerator includes a freezing compartment 2, a refrigerating compartment 3, a kimchi compartment 4 and a vegetable compartment 5 which are superimposed one upon the other from above within a body 1 thereof. The freezing compartment 1 and the refrigerating compartment 2 are equipped with doors 2A,2B,3A and 3B at the front portion of the compartments 1 and 2, respectively. Each door 2A,2B,3A and 3B is hinged along the vertical axis on the sides of each compartment. The kimchi compartment 4 has a door 4A, located at the front of the kimchi compartment 4, which is hinged at the lower horizontal corners of the door 4A. The vegetable compartment 5 has a door 5A, located at the front of the vegetable compartment 5, which is formed to be on integral part of the vegetable box to facilitate it's sliding forward or backward. Each of the doors 2A and 3A of the freezing compartment 2 and the refrigerating compartment 3 respectively contains a shelf 6 located at the inward facing surface of each door 2A and 3A. A vertical side wall 6A of the shelf 6 is located adjacent to the non-hinged portion of each door 2A and 3A. The cool air leak prevention device 7 is mounted on the side wall 6A so that it can freely rotate on the hinges. The cool air leak prevention device 7 prevents the leakage of air through the gap which is formed between the opened door 2A,3A and the closed door 2B,3B.

Figure 2:
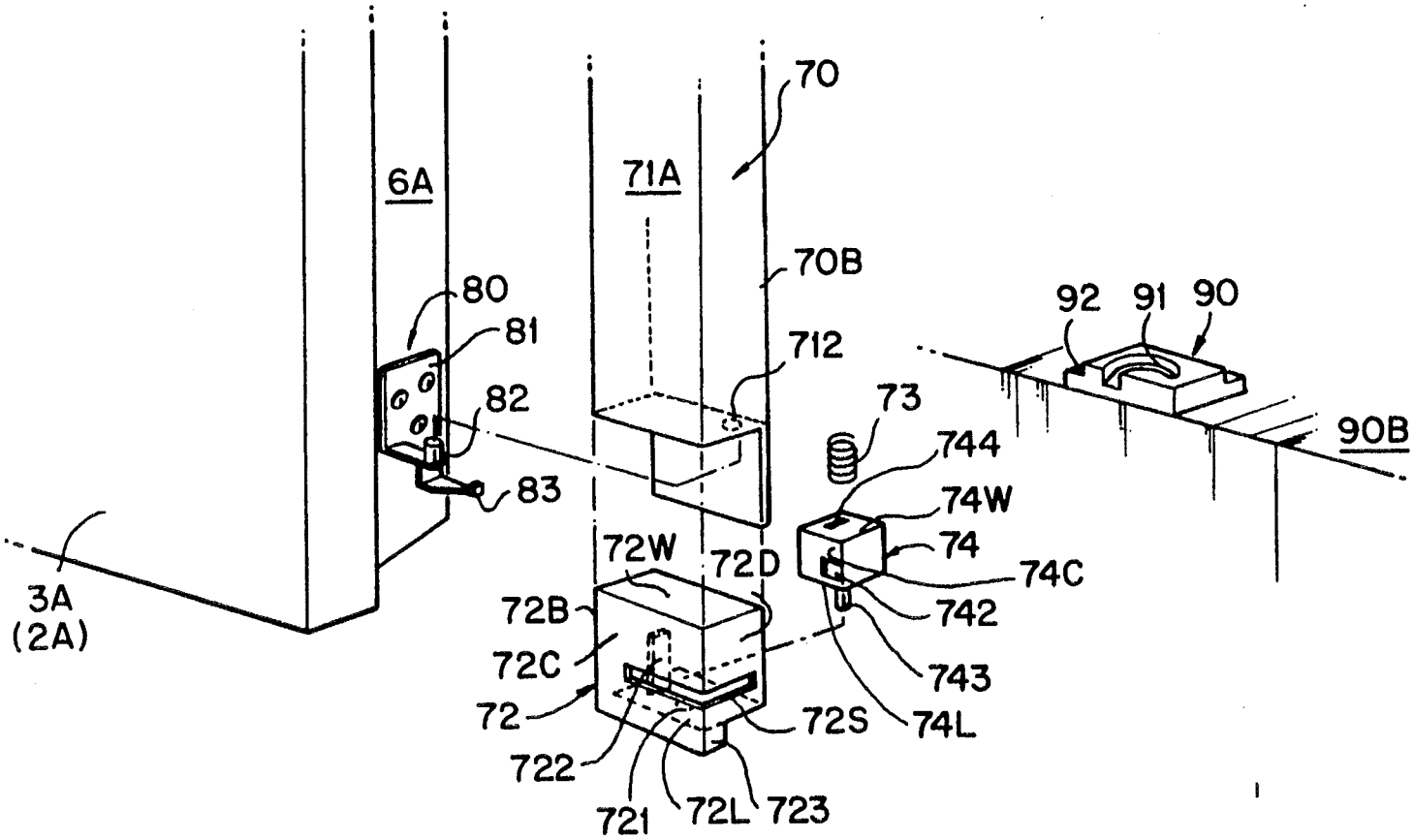
FIG. 2 is a perspective exploded view of the cool air leak prevention device in according to the present invention.
Figure 4:
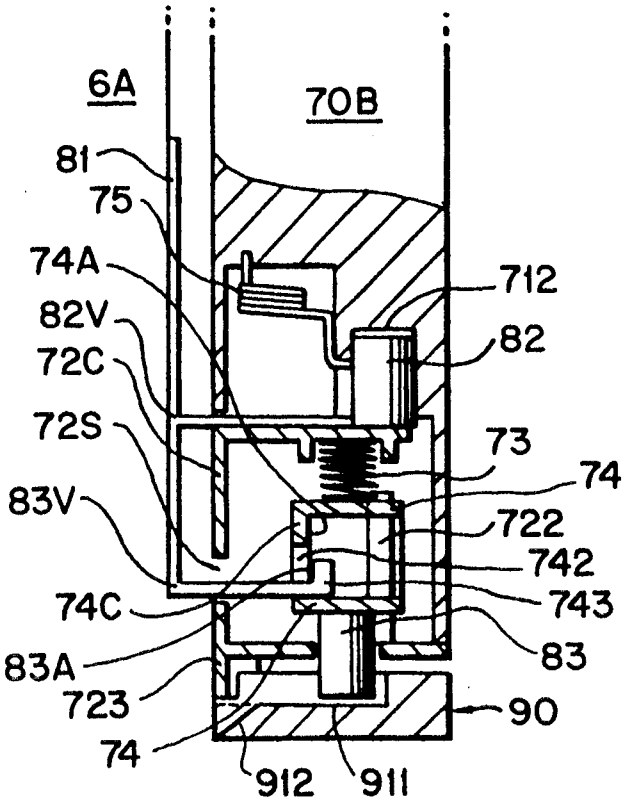
FIG. 4 is a transverse section of the leak prevention device in FIG. 3 when the door is closed.
Figure 3:
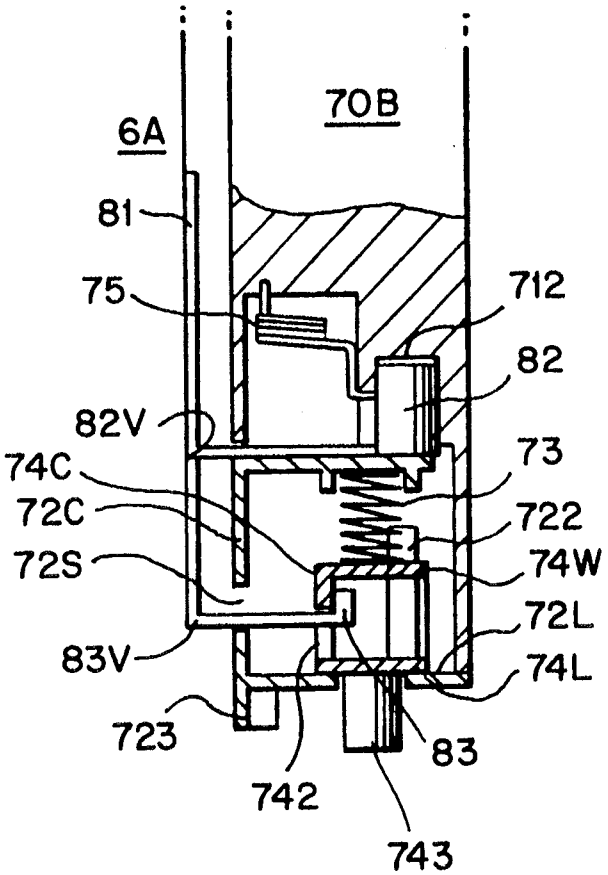
FIG. 3 is transverse section partially in cross section, taken on the lime III—III in FIG. 1.
Figure 7:
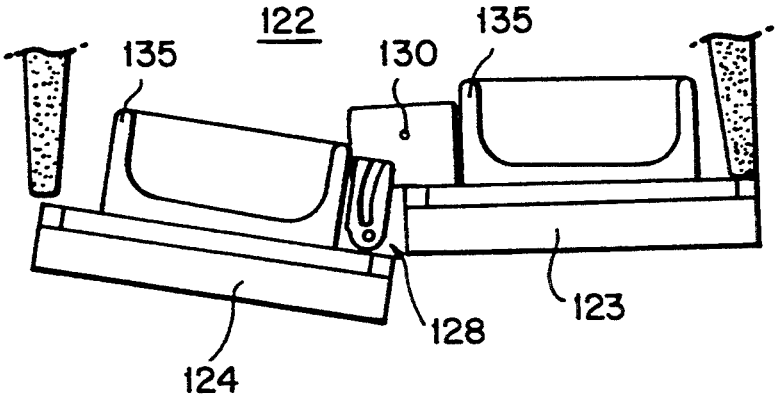
FIG. 7 (PRIOR ART)
FIG. 7 is a fragmentary plan view of an opened door employing a cool air leak prevention device in accordance with prior art.
Figure 8:
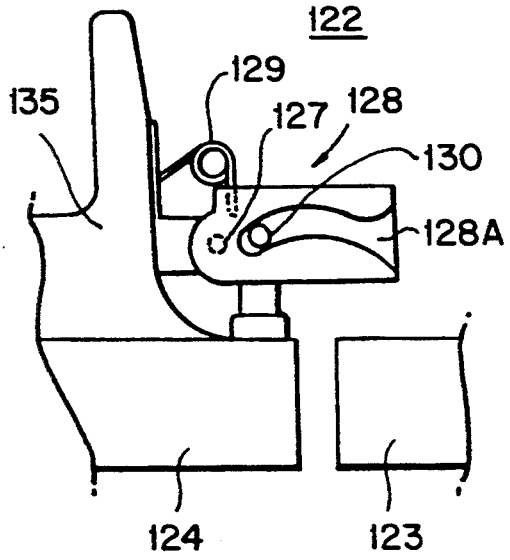
FIG. 8 (PRIOR ART)
FIG. 8 is an enlarged view of a cool air leak prevention device of a preferred embodiment of the prior art in FIG. 7.
Figure 9:
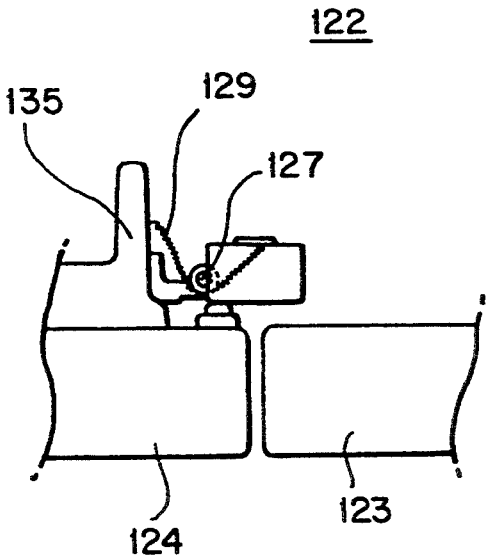
FIG. 9 (PRIOR ART)
FIG. 9 is an enlarged view of a cool air leak prevention device of an alternative preferred embodiment of the prior art in FIG. 7.

FIG. 2 illustrates a cool air leak prevention device. FIG. 3 illustrates a door in the open position and FIG. 4 illustrates door in the closed position.

The cool air leak prevention device 7 comprises a cool air leak prevention member 70 which is located in the inside of each of the doors 2A and 3A and covers the gap between the paired doors 2A and 2B, and 3A and 3B. Further, the cool air leak prevention device 7 comprises a mounting member 80 which is attached on the non-hinged side wall 6A so that the cool air leak prevention member 70 can freely pivot. Furthermore, the cool air leak prevention device 7 comprises a guiding member 90 which is located adjacent to the front edge of each lower surface 90B of each of the compartments 2,3 in order to enhance the smooth movement of the cool air leak prevention member 70.

The cool air prevention member 70 includes a rectangular body 70B formed longitudinally across the side wall 6A and a support 72 attached to the lower part of the body 70B. At the lower plate of the body 70B a hole 712 is provided for the rotation of the device assembled on the hinge 82 of the mounting member 80. Inside the body 70B a coil spring 75 is positioned to provide the cool air prevention member 70 with a resilient force (FIG. 3). One end of the spring 75 is inserted in the body 70B, while the other end of the spring 75 is inserted in the wall adjacent to the hole 712. The spring 75 pushes the rear wall 71A of the body 70B to face to the surface of the side wall 6A as illustrated in FIG. 5A.

The support 72 includes a rectangular body 72B, a locking portion 74 installed on the inside of the body 72B and a spring 73 which is located between the inside surface of the top surface 72W of the body 72B and the outside surface of the top surface 74W of the locking portion 74 in order to constantly depress the locking portion 74.

The body 72B has a rear wall 72C which is formed parallel to the rear wall 71A of the body 70B and a side wall 72D formed to adjoin the rear wall 72C. A slot 72S is formed longitudinally to the rear wall 72C and the side wall 72D. Through the slot 72S a protruding portion 83, which will be explained below, of the mounting member 60 moves out and in. A guide column 722 is formed in an upright position on the bottom surface 72L of the support 72.

The body 72B further has a cool air flow blocking portion 723 which is formed in the bottom surface 72L along the edge parallel to the rear wall 72C. The air flow blocking portion 723 prevents the cool air in the compartment from leaking through the gap between the doors because the outer surface of the rear wall 72C faces the interior space of the compartment 3 when the door is closed as illustrated at FIG. 6D.

The locking portion 74 has a guiding opening 744 which is formed at both the upper surface 74W and the bottom surface 74L, respectively ( FIGS. 3 and 4 ). Through these guiding openings 744 the guide column 722 is inserted to allow the locking portion 74 to easily move up and down along the guide column 722. The locking portion 74 has additionally a notch 742 at the side wall 74C of the locking portion 74 facing the rear wall 72C of the support 72. The locking portion 74 has also a guiding shaft 743 which is formed in the bottom surface 74L of the locking portion 74. The guiding shaft 743 is inserted into the opening 721 which is formed at the lower surface 72L of the support 72.

The mounting member 80 includes a plate 81 attached to the side wall 6A of the shelf and a hinge 82 which is located at the tip of the vertically extending portion or in the right hand direction from the lower point 82V of the plate 81 (FIG. 3). The hinge 82 is inserted into the hole 712 of the cool air prevention member 70 to facilitate the smooth rotation of the cool air prevention member 70.

The mounting member 80 further includes a protruding portion 83 which is formed in an upright position at the tip of the vertically extending portion or in the right hand direction from the lower point 83V, located at a level lower than the lower point 82V of the plate 81 (FIG. 3). The protruding portion 83 is inserted through the slot 72S and then through the notch 742 so as to be locked to the locking portion 74. That is, the protruding portion 83 defines a locking surface 83A which lies in the path of travel of a locking surface 74A defined by the locking portion 74 in order to prevent rotation of the leak prevention member 70 clockwise in FIG. 5A.

The guiding member 90 has an arch shaped groove 91 at the upper surface of the guiding member 90 (FIG. 5A). The groove 91 includes a slanting surface 912 formed at the beginning section of the guiding member 90 for inducing the upward motion of the shaft 743 of the locking portion 74. The groove 91 includes additionally a guiding surface 911 which extends from the end of the slanting surface 912 for guiding the movement of the shaft 743. The guiding member 90 further includes a guiding surface 92 along the groove 91 at the interior of the guiding member 90 which faces the compartment 3. The guiding surface 92 guides the movement of the cool air leak blocking portion 723.

In FIGS. 5A,5B,5C and 5D, the operation of the cool air leak prevention device is illustrated.

In FIGS. 6A,6B,6C and 6D, the operation of the blocking portion 723 of the cool air leak prevention device is illustrated.

When door 2A or 3A is opened as shown in FIG. 1, the leak prevention device 70 is in a retracted position wherein the rear wall 71A of the cool air leak prevention device 7 faces the non-hinged side wall 6A of the shelf 6 as illustrated in FIG. 5A. This is accomplished by the force of the spring 75 of the cool air leak prevention member 70 (FIG. 3). Because the spring 73 pushes down against the upper surface 74W of the locking portion 74, the bottom surface 74L of the locking portion 74 contacts the upper surface 72L of the support 72. The part of the rear wall 74C formed at the upper edge of the notch 742 is locked with the protruding portion 83 of the mounting member 81 which becomes inserted into the locking portion 74 through the notch 742. Thus, the cool air preventing member 70 can not rotate on the hinge 82 in a direction out from the plane of the paper when viewed in FIG. 3.

When door 2A or 3A is in the closing motion as shown in FIGS. 5B and 5C, the moving shaft 743 of the locking portion 73 is introduced into the groove 91 of the guiding member 90. As the door is continuously closed, the shaft 743 moves on the ascendent slanting surface 912. Along with the upward movement of the shaft 743 the locking portion 74 also moves upward as illustrated in FIG. 4. The locked position of the protruding portion 83 which was restricted by the rear wall 74C of the locking portion 74 is then released. In FIG. 5, the shaft 743 subsequently moves onto the guiding surface 911 passing the slanting surface 912 causing the cool air leak prevention member 70 to rotate on the hinge 82 in a clockwise direction. The protruding portion 83 which is freed from the restricted position extends through the notch 742. With the rotation of the cool air leak prevention member 70, the protruding portion 83 extends through the slot 72S.

In FIGS. 5D and 6D, the completely closed position of the door is illustrated. The external surface of the rear wall 71A faces the compartment 3. After the blocking portion 723 of the support 72 travels along the guiding surface 92, the leak prevention member 70 will have rotated to an operative position in which the rear outside surface of the blocking portion 723 faces the compartment 3. Thus, the position of the blocking portion 723 prevents the cool air in the compartment from leaking directly through the gap between the bottom surface 72L of the support 72 and the upper surface of the guiding member 90.

The procedure for opening the door can be achieved by reversing the above described door closing procedure. When door 2A or 3A is opened, the rear wall 71A which faces the interior of the compartment is rotated on the hinge 82 in a counter-clock wise direction. The moving condition is illustrated in FIG. 5D,5C,5B and 5A, or in FIG. 6D,6C,6B and 6A. The protruding portion 83 enters into the slot 72S and then into the notch 742. As, the shaft 743 moves down along the surface 912, the locking portion 74 is moved down by the expansion force of the spring 73. At the same time, the rear wall 74C with the notch 742 is pressed down so that the protruding portion 83 which enters into the notch 742 and becomes interlocked with the notch 742. That is, when the door is in the open condition, the cool air leak prevention member 70 is situated as shown in FIGS. 3, 5A and 6A and is locked by the protruding portion 83.

In the above described situation where the door is in the open position, the rear wall of the cool air leak prevention member always faces the non hinged side surface of the shelf of the door. That is, even if an unwanted force is applied to the cool air leak prevention member, the rear wall of the cool air leak prevention member can not be rotated to face the interior of the compartment when the door is in the open position. Thus, only when the door is in the closed position can the cool air leak prevention member be rotated. Whenever the other door which is not equipped with the cool air leak prevention member is closed prior to the door having the cool air leak prevention member, the cool air leak prevention member cannot be damaged.

Further, the cool air blocking member is placed on the guiding surface of the guiding member and thus the cool air in the compartment can be prevented from directly leaking through the gap between the cool air leak prevention member and the guiding member.

What is claimed is:

1. A refrigerator comprising:

a body defining a compartment;

first and second doors mounted in side-by-side relationship on said body for closing said compartment, each door having two vertical edges and being hinged along one of said vertical edges, so that the other vertical edges of the doors are disposed adjacent one another when the doors are closed to form a gap therebetween;

leak preventing means including:

a leak prevention member mounted on a rear side of said first door for movement between retracted and operative positions, said leak prevention member, when in its operative position, extending across said gap formed by the closed doors for blocking the escape of cold air through said gap, and locking means for locking said leak prevention member in its retracted position when said first door is in an open position, said locking means comprising a first locking surface on said leak prevention member, and a second locking surface on said first door, said locking means being disposable in an unlocking state in which said leak prevention member is movable to said operative position, and in a locked state in which said second locking surface is arranged in the path of travel of said first locking surface for blocking movement of said leak prevention member to said operative position; and guiding means mounted on said body for guiding said leak prevention member to its operative position in response to closing of said first door when said locking means is in said unlocking state.

2. A refrigerator according to claim 1 including unlocking means for moving said locking means to said unlocking state in response to closing of said first door.

3. A refrigerator according to claim 2, wherein said unlocking means is mounted on said body.

4. A refrigerator according to claim 3, wherein said locking means includes a locking element movable between first and second positions corresponding to said locking and unlocking states, respectively, said locking element carrying one of said first and second locking surfaces, said unlocking means including an inclined surface arranged to be contacted by said locking element in response to closing of said first door for urging said locking element to said second position for unlocking said leak prevention member.

5. A refrigerator according to claim 4, wherein said locking element is mounted on said leak prevention member for movement therewith and carries said first locking surface.

6. A refrigerator according to claim 5, wherein said locking means further includes a stationary member mounted on said door and carrying said second locking surface.

7. A refrigerator according to claim 5 including first spring means biasing said locking element to said first position.

8. A refrigerator according to claim 5, wherein said locking element is movable vertically between said first and second positions.

9. A refrigerator according to claim 8, wherein said locking element includes a shaft arranged to ride upon said inclined surface.

10. A refrigerator according to claim 9, wherein said guiding means includes a curved groove arranged such that said inclined surface is disposed at one end of said groove, whereby said shaft travels in said groove after riding along said inclined surface during closing of said first door.

11. A refrigerator according to claim 10, wherein said locking element includes a wall portion extending behind said groove when said first door is closed, for blocking leakage of cold air between said guiding means and said locking element.

12. A refrigerator according to claim 11, wherein said shaft and said wall portion projecting in a downward direction.

13. A refrigerator according to claim 1 including spring means biasing said leak prevention member to said retracted position.

14. A refrigerator according to claim 1, wherein said leak prevention is rotatable about a vertical axis between said retracted and operative positions.

* * * * *